US008133099B2

(12) United States Patent
Wang

(10) Patent No.: US 8,133,099 B2
(45) Date of Patent: Mar. 13, 2012

(54) RECIPROCATING DRIVE MECHANISM OF ABRASIVE BAND GRINDING MACHINE

(75) Inventor: Tian Wang Wang, Taiping (TW)

(73) Assignee: Mao Shan Machinery Industrial Co., Ltd., Taichung Hsien (TW)

( * ) Notice: Subject to any disclaimer, the term of this patent is extended or adjusted under 35 U.S.C. 154(b) by 897 days.

(21) Appl. No.: 12/219,722

(22) Filed: Jul. 28, 2008

(65) Prior Publication Data

US 2010/0022173 A1 Jan. 28, 2010

(51) Int. Cl.
*B24B 21/00* (2006.01)

(52) U.S. Cl. ..... 451/168; 451/304

(58) Field of Classification Search ..... 451/162, 451/164, 168, 304
See application file for complete search history.

(56) References Cited

U.S. PATENT DOCUMENTS

| | | | | |
|---|---|---|---|---|
| 5,916,014 | A * | 6/1999 | Schroeder et al. | 451/121 |
| 6,102,787 | A * | 8/2000 | Schroeder et al. | 451/304 |
| 6,386,958 | B1 * | 5/2002 | Wang | 451/65 |
| 6,471,568 | B1 * | 10/2002 | Wang | 451/168 |
| 7,090,571 | B1 * | 8/2006 | Wang | 451/296 |
| 7,238,094 | B2 * | 7/2007 | Liu | 451/304 |

* cited by examiner

*Primary Examiner* — Timothy V Eley

(57) ABSTRACT

The present invention provides a reciprocating lifting motion of abrasive band grinding machine, wherein two control boxes are arranged correspondingly at lower part of the grinding mechanism of the grinding machine; the grinding mechanism is driven by the drive axle of the control box; a motor is coupled below the control box, and the control box is provided with a lifting mechanism, which is adapted with the cam via a main drive axle with worm gear; based on the eccentric rotation characteristic of the cam, the main drive axle could generate reciprocating lifting motion, driving the continuous operation of the grinding mechanism for uniform grinding of the abrasive band surface.

8 Claims, 7 Drawing Sheets

RECIPROCATING DRIVE MECHANISM OF ABRASIVE BAND GRINDING MACHINE

BACKGROUND OF INVENTION (1) Field of the Invention

The present invention relates generally to a reciprocating lifting mechanism mounted onto the grinding machine, and more particularly to an innovative one which allows the abrasive band grinding machine to generate continuous lifting motion so as to grind uniformly the abrasive band and prolong efficiently its life span.

(2) Description of the Prior Art

A conventional abrasive band grinding machine is generally driven by a motor to conduct the grinding operation through continuously rotating abrasive band. However, the following shortcomings are observed during actual applications:

1) Since the abrasive band of fixed grinding height has a higher frequency of utilization and contact, some saw dusts are inclined to be accumulated on the surface of the abrasive band. This will affect the heat dispersion of abrasive band surface, and possibly lead to its wear and rupture under continuous operating state.

2) Excessive accumulation of saw dusts on the abrasive band will also affect the grinding capacity, leading to non-uniform grinding of the surface of workpieces.

3) The operator has to clean up regularly the surface of abrasive band for maintaining the efficiency, but this will bring about inconvenience and delay of operation.

4) The surface of abrasive band isn't fully utilized, but the abrasive band will be replaced if some sections of higher utilization frequency are damaged, leading to waste of materials and more burden of cost.

SUMMARY OF THE INVENTION

For the reasons mentioned above, the major purpose of the present invention is to install two control boxes at lower part of the grinding machine, and allow a lifting mechanism within the control box to control the reciprocating motion of the grinding machine, thereby achieving uniform grinding of the surface of abrasive band.

Another purpose of the present invention is to reduce efficiently the wear of fixed section on the abrasive band, and prolong the life span of the abrasive band.

The other purpose of the present invention is to generate multi-directional grinding of the workpieces via reciprocating motion of the lifting mechanism, thus yielding better grinding effect and reducing the saw dusts on the abrasive band for improved heat dispersion.

DETAILED DESCRIPTION OF THE PREFERRED EMBODIMENTS

The features and the advantages of the present invention will be more readily understood with reference to the accompanying drawings.

Figure 1:
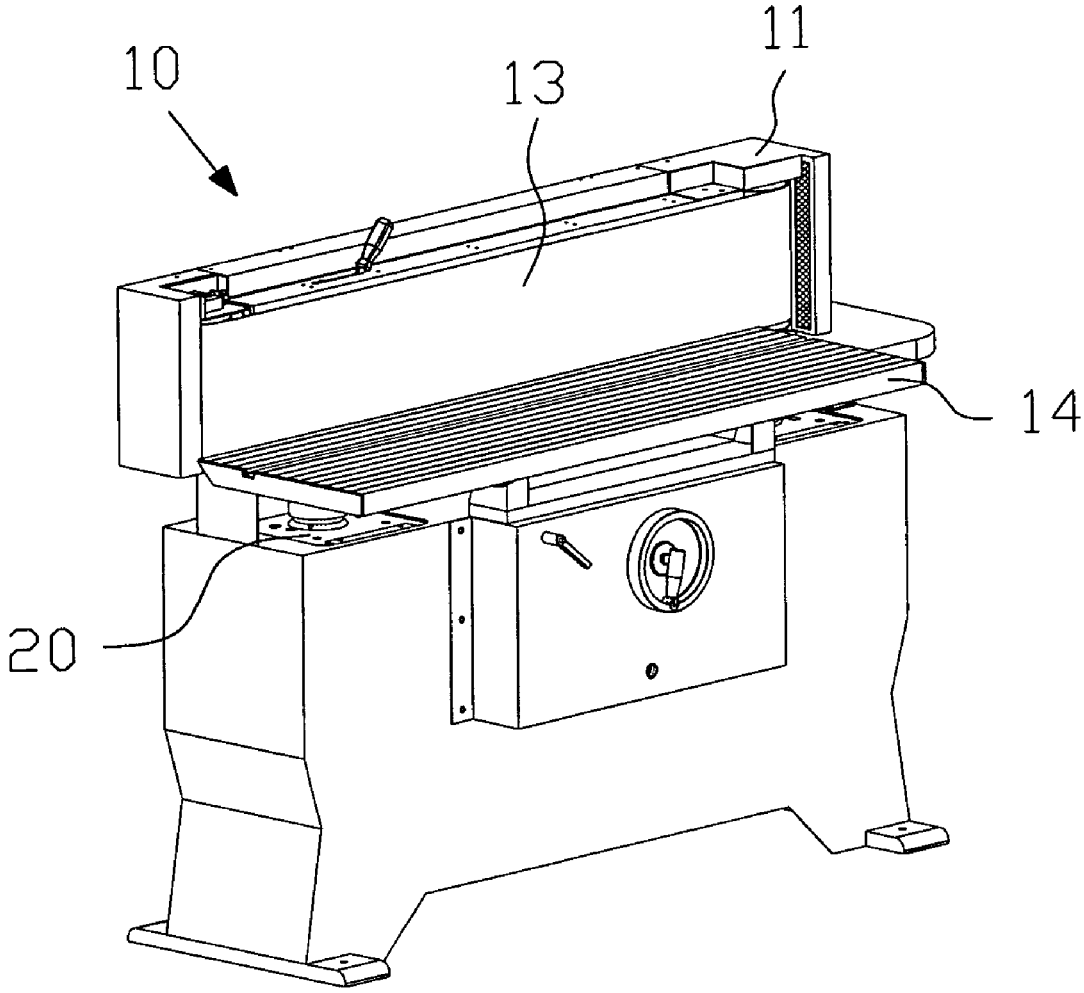
FIG. 1 depicts a schematic view of abrasive band grinding machine of the present invention.
Figure 2:
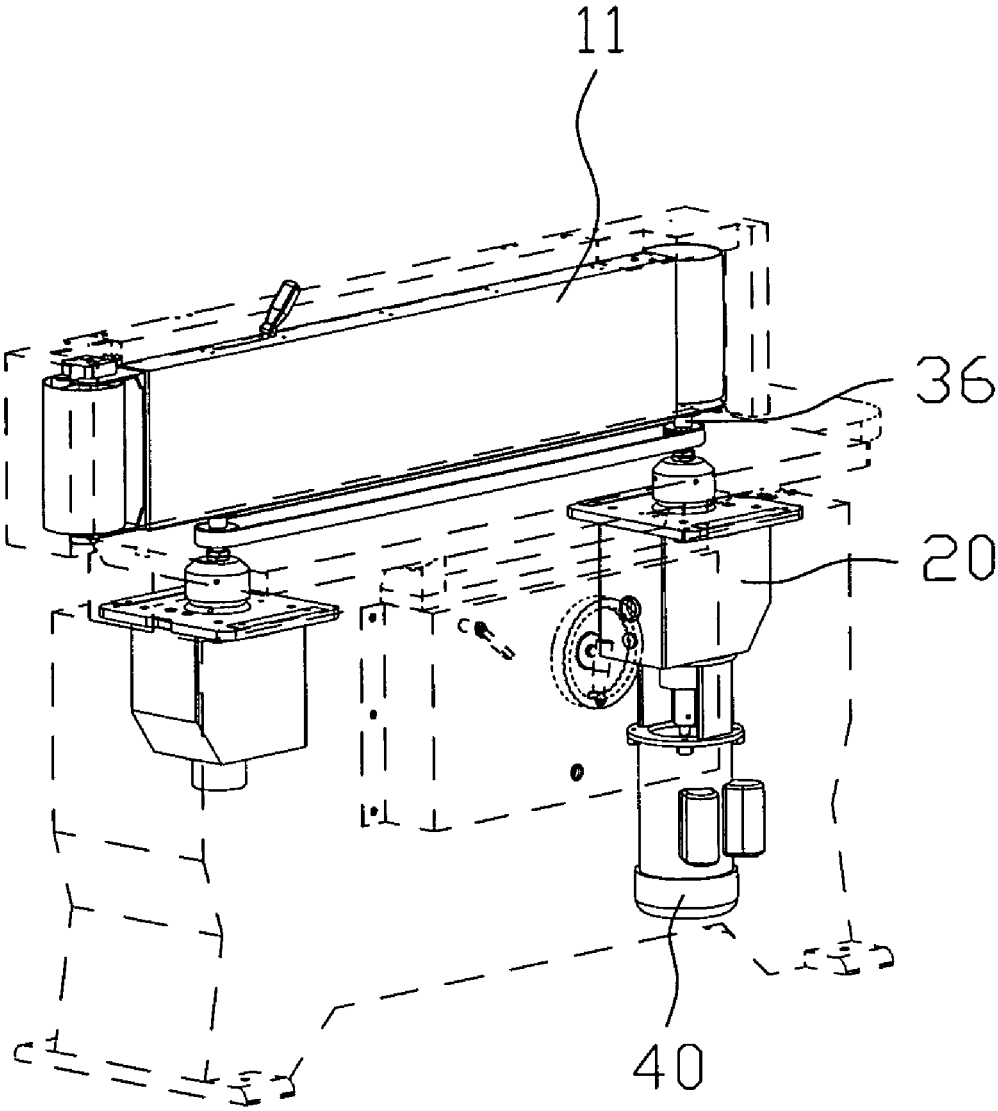
FIG. 2 depicts an assembled view of the present invention.

Referring firstly to FIG. 1—schematic view of abrasive band grinding machine of the present invention, and FIG. 2—an assembled view of the present invention, wherein two control boxes 20 are arranged correspondingly at lower part of the grinding mechanism 11 of the grinding machine 10; the grinding mechanism 11 is driven by the drive axle 36 of the control box 20, while a motor 40 is coupled below the control box 20; an abrasive band 13 is mounted onto the grinding mechanism 11, and a worktable 14 for placement of articles is arranged at one side of the grinding mechanism 11.

Figure 3:
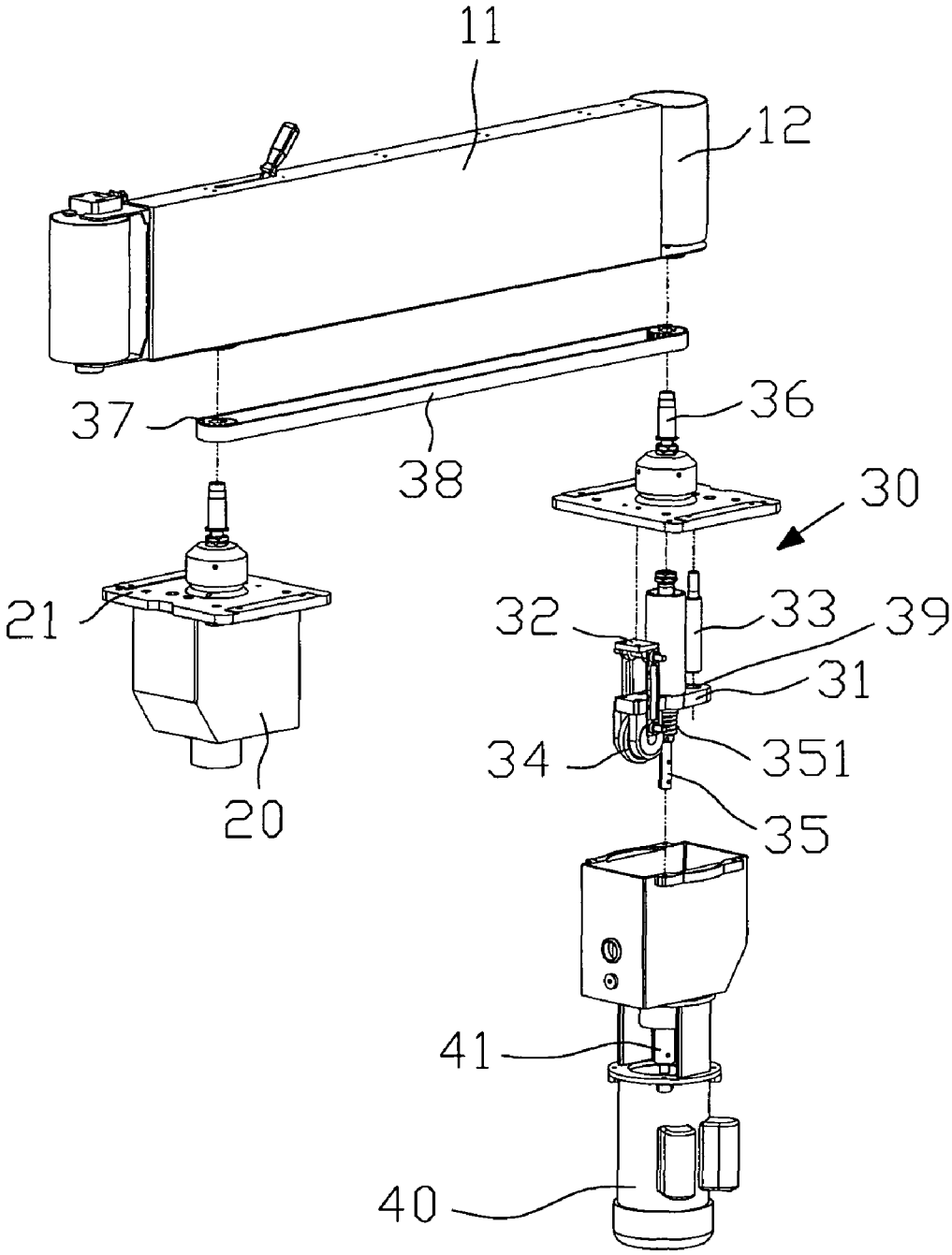
FIG. 3 depicts an exploded view of the present invention.

Referring also to FIG. 3, an exploded view of the present invention, wherein a lifting mechanism 30 is placed within the control box 20; the lifting mechanism 30 comprises: a main drive axle 35 with a worm gear 351, which is connected with mandrel 41 of the motor 40; a balancing seat 31 is screwed on the main drive axle 35; a cam 34 and a fixed frame 32 are arranged at one side of the balancing seat 31, and a hole 39 placed on the other side; the cam 34 is coupled with the worm gear 351 of the main drive axle 35 in a rotary state; in addition, the fixed frame 32 is secured at lower part of the upper cover 21 of the control box 20, while a balancing rod 33 is installed at the other side of the lower part of the upper cover 21, and also aligned with the hole 39 of the balancing seat 31.

Moreover, the main drive axle 35 is connected with a drive axle 36 protruded from the control box 20; the drive axle 36 is connected with the abrasive band wheel 12 on the upper part of the grinding mechanism 11; a gear 37 is sleeved onto the drive axle 36, and a drive belt 38 is used to connect gear 37 protruded from the control box 30, so that both lifting mechanisms 30 could generate simultaneously reciprocating lifting motion.

Figure 4:
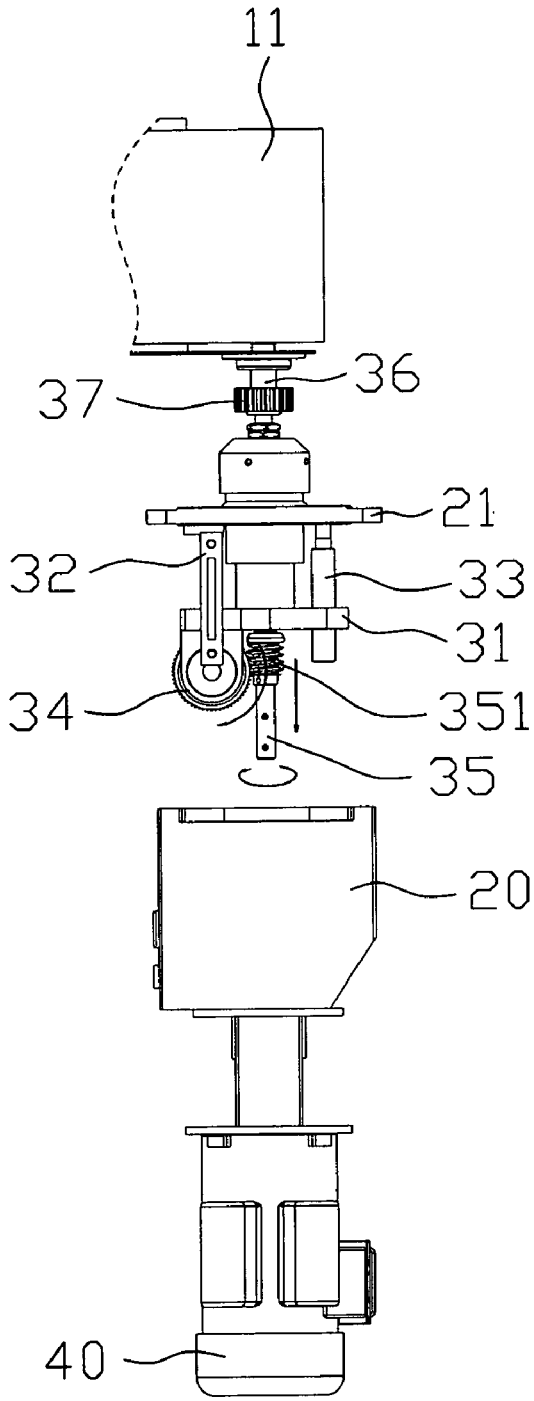
FIG. 4 depicts relational view 1 of the lifting mechanism of the present invention.
Figure 5:
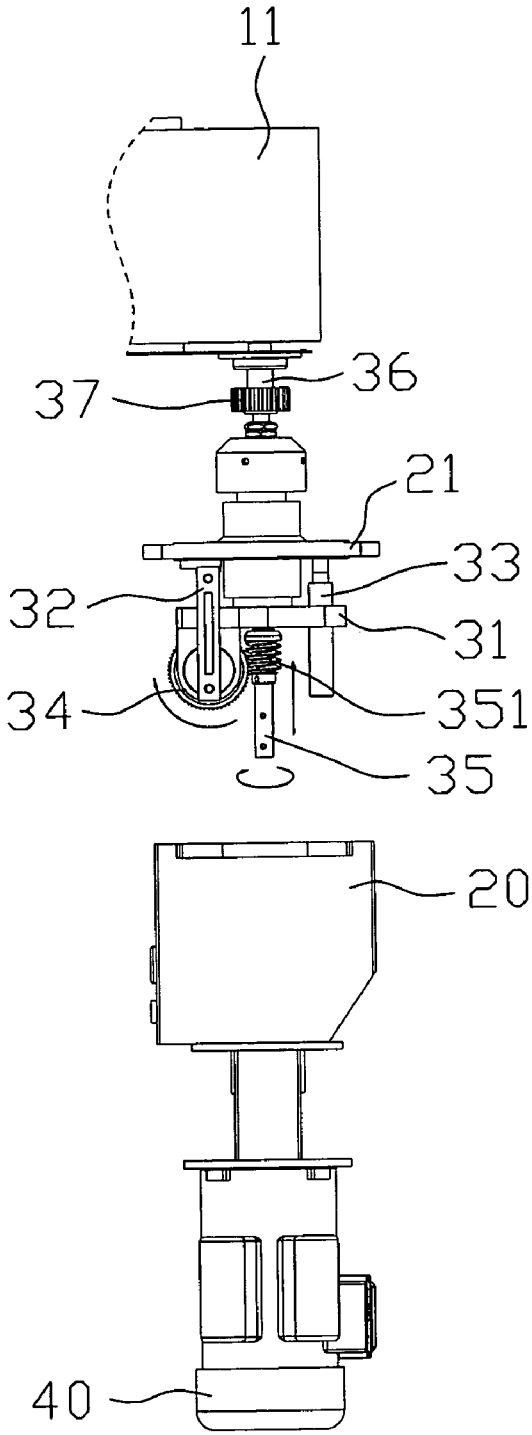
FIG. 5 depicts relational view 2 of the lifting mechanism of the present invention.

Referring to FIGS. 4~5—relational view of the lifting mechanism, wherein the cam 34 is connected with the worm gear 351 of main drive axle 35 in a rotary state; based on the eccentric rotating structure of the cam 34 and fixed frame 32, the main drive axle 35 could rotated in a single direction to generate reciprocating lifting motion under the drive of the cam 34.

Figure 6:
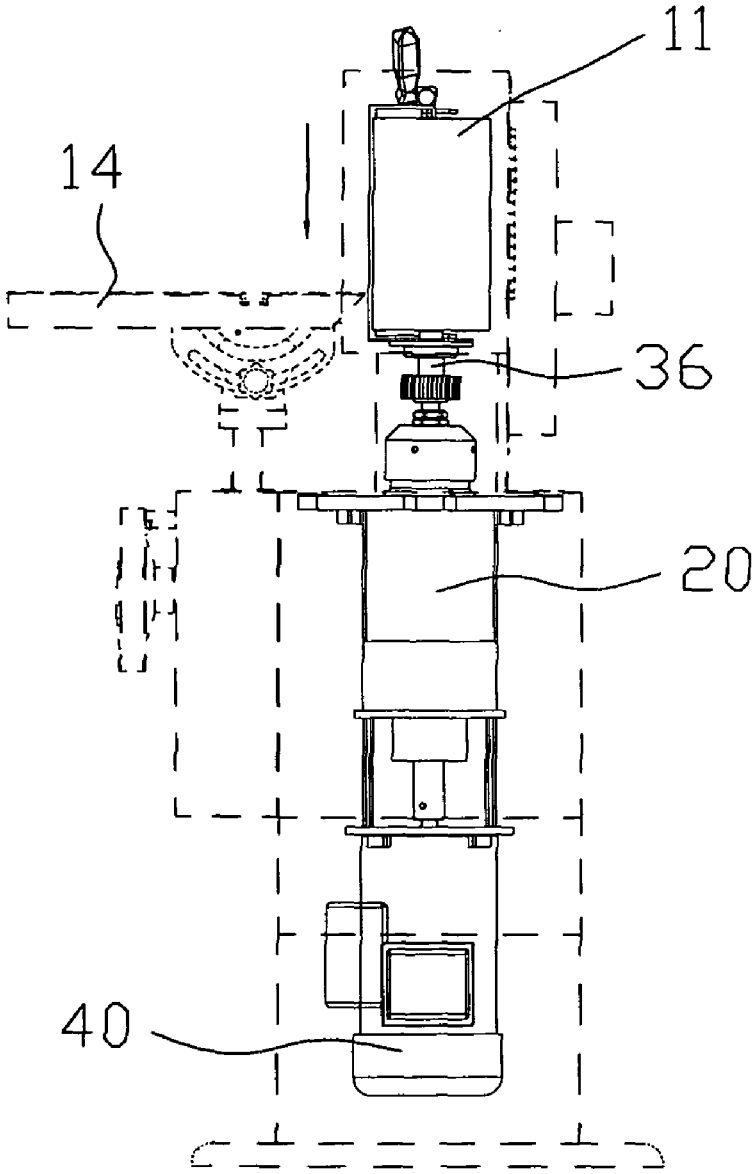
FIG. 6 depicts lifting view 1 of the present invention.
Figure 7:
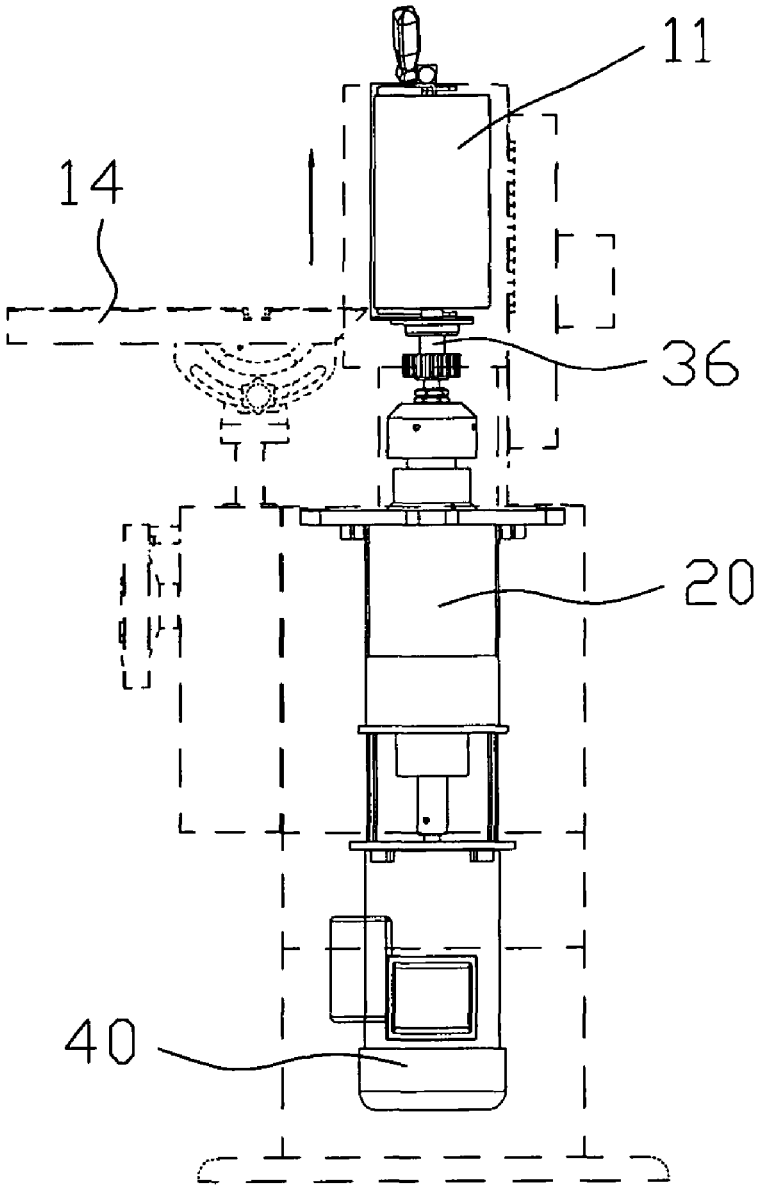
FIG. 7 depicts lifting view 2 of the present invention.

Referring also to FIGS. 6~7—lifting view of the present invention, wherein the grinding mechanism 11 generates continuous lifting motion via the lifting mechanism 30, such that the surface of the abrasive band 13 could be smoothed uniformly with declining accumulation of sawdust.

Although the invention has been explained in relation to its preferred embodiment, it is to be understood that many other possible modifications and variations can be made without departing from the spirit and scope of the invention as hereinafter claimed.

What is claimed is:

1. A drive mechanism of an abrasive band grinding machine, comprising two control boxes arranged correspondingly at a lower part of a grinding mechanism of the abrasive band grinding machine;

one of the two control boxes including a lifting mechanism which has a main drive axle connecting with a motor;

the grinding mechanism being driven by a drive axle of each of the two control boxs;

wherein the main drive axle of the lifting mechanism is connected with the motor, and a cam is arranged at one side of a balancing seat which is screwed on the main axle so that the main drive axle generates a reciprocated lifting motion, driving a continuous operation of the grinding mechanism.

2. The mechanism defined in claim 1, wherein said drive axle is connected with an abrasive band wheel of the grinding mechanism.

3. The mechanism defined in claim 1, wherein said cam is coupled with a worm gear of the main drive axle in a rotary state.

4. The mechanism defined in claim 1, wherein the main drive axle is connected with the drive axle of the control box.

5. The mechanism defined in claim 1, wherein a gear is fitted onto the drive axle which connects with the main drive axle, and a drive belt is used to connect with the gear.

6. The mechanism defined in claim 1, wherein the balancing seat is screwed on the main drive axle of the drive mechanism within the control box; the cam and a fixed frame are arranged at the one side of the balancing seat, and a hole placed on another side of the balancing seat.

7. The mechanism defined in claim 6, wherein the fixed frame is secured at a lower part of an upper cover of the one of the two control boxes including the lifting mechanism, while a balancing rod is installed at one side of the lower part of the upper cover and is aligned with the hole of the another side of the balancing seat.

8. The mechanism defined in claim 6, wherein the cam and fixed frame are connected with an eccentric rotating structure.

* * * * *